US008517033B2

(12) United States Patent
Martinelli

(10) Patent No.: US 8,517,033 B2
(45) Date of Patent: Aug. 27, 2013

(54) HAIRSTYLING TOOL

(75) Inventor: Suzanne Martinelli, Wilmington, DE (US)

(73) Assignee: Bombshell Beauty, Inc., Wilmington, DE (US)

( * ) Notice: Subject to any disclaimer, the term of this patent is extended or adjusted under 35 U.S.C. 154(b) by 0 days.

(21) Appl. No.: 13/352,834

(22) Filed: Jan. 18, 2012

(65) Prior Publication Data

US 2013/0180538 A1 Jul. 18, 2013

(51) Int. Cl.

| | |
|---|---|
| ***A45D 8/38*** | (2006.01) |
| ***A45D 8/00*** | (2006.01) |
| ***A45D 24/04*** | (2006.01) |
| ***A41G 3/00*** | (2006.01) |
| ***A41G 5/00*** | (2006.01) |

(52) U.S. Cl.

USPC ..... 132/201; 132/106; 132/126; 132/54; 132/273

(58) Field of Classification Search

USPC ..... 132/106, 200, 201, 53–55, 105, 207, 132/60, 212, 270, 272, 273, 274, 275, 144, 132/145, 146, 148, 245, 333, 107, 246, 247, 132/254; D28/10, 32, 92, 93, 99; D2/871, D2/875; 2/171, 171.02, 171.4, 173.5, 182.7, 2/209.13; 623/15.11, 15.12; 606/187

See application file for complete search history.

(56) References Cited

U.S. PATENT DOCUMENTS

| | | | | |
|---|---|---|---|---|
| 459,000 | A | 9/1891 | Emery | |
| 712,657 | A * | 11/1902 | Davis | 132/106 |
| 731,575 | A * | 6/1903 | Johnston | 132/106 |
| 774,990 | A * | 11/1904 | Newton | 132/106 |
| 794,479 | A | 7/1905 | Austin | |
| 800,846 | A * | 10/1905 | Hamilton | 132/129 |
| 886,034 | A | 4/1908 | Bechtold | |
| 953,587 | A * | 3/1910 | Bond | 132/106 |
| 1,409,720 | A * | 3/1922 | Hurewich | 132/54 |
| 1,526,440 | A | 2/1925 | Skaruda | |
| 1,595,595 | A | 8/1926 | Bonat et al. | |
| 1,714,358 | A | 5/1929 | Finkelstein | |
| 1,824,087 | A * | 9/1931 | Krag | 132/106 |
| 2,796,069 | A * | 6/1957 | Mooney, Jr. | 132/273 |
| 3,126,020 | A * | 3/1964 | Sidelman | 132/54 |
| 3,342,189 | A * | 9/1967 | Houston | 132/53 |

(Continued)

FOREIGN PATENT DOCUMENTS

EP 182599 A2 * 5/1986

OTHER PUBLICATIONS

Fusion Group International Hair Stylers Black Mesh Chignon internet web page http://www.sallybeauty.com/mesh-chignon/FUSGRP01.default.pd.html?cm_vc=search, Jan. 18, 2012.

*Primary Examiner* — Vanitha Elgart

(74) *Attorney, Agent, or Firm* — Jeffrey C. Lew

(57) ABSTRACT

A hairstyling tool has a thick, soft cushioned body adapted to be worn on the top of head close to the scalp in skull cap-like fashion. Hair clips affixed to the bottom of the body can be deployed to maintain the tool in position. A substantially vertical channel extending completely through the body allows the wearer to draw sheaves of hair fibers from below the body up, through and above the tool. The upwardly drawn hair fibers can be teased, combed, brushed or otherwise arranged together with other hair of the wearer in a highly elevated style resting on top of the body.

12 Claims, 6 Drawing Sheets

(56) References Cited

U.S. PATENT DOCUMENTS

| | | | | | |
|---|---|---|---|---|---|
| 3,419,020 | A * | 12/1968 | Courtney | 132/54 |
| 3,452,761 | A * | 7/1969 | Siegel | 132/106 |
| 3,693,637 | A * | 9/1972 | Sidelman | 132/55 |
| 4,254,783 | A | 3/1981 | Kim | |
| 4,259,972 | A * | 4/1981 | Spaccapaniccia | 132/212 |
| 4,819,671 | A * | 4/1989 | Walker | 132/54 |
| 5,706,837 | A * | 1/1998 | Iwata | 132/200 |
| 5,765,571 | A * | 6/1998 | Dinnel | 132/210 |
| 5,769,101 | A * | 6/1998 | Iwata | 132/273 |
| 5,845,655 | A * | 12/1998 | Iwata | 132/212 |
| 5,845,657 | A * | 12/1998 | Carberry et al. | 132/273 |
| D406,398 | S * | 3/1999 | Kageyama et al. | D28/93 |
| 6,035,861 | A | 3/2000 | Copello | |
| 6,276,368 | B1 * | 8/2001 | Giamalva | 132/201 |
| 7,264,003 | B2 * | 9/2007 | Chayeb | 132/54 |
| 7,484,512 | B2 | 2/2009 | Martinelli et al. | |
| 7,798,155 | B2 * | 9/2010 | Schweers et al. | 132/273 |
| D627,509 | S * | 11/2010 | Tsai | D28/10 |
| D632,427 | S * | 2/2011 | Shimizu | D28/10 |
| D633,651 | S * | 3/2011 | Robinson-Scott | D28/10 |
| 8,074,664 | B2 * | 12/2011 | Ruckdeschel | 132/275 |
| 2005/0194015 | A1 * | 9/2005 | Watts | 132/53 |
| 2005/0268927 | A1 * | 12/2005 | Alcala | 132/53 |
| 2006/0174907 | A1 * | 8/2006 | Morris et al. | 132/274 |
| 2009/0071497 | A1 * | 3/2009 | Szlanfucht et al. | 132/210 |
| 2009/0288673 | A1 * | 11/2009 | Park | 132/200 |
| 2010/0012140 | A1 * | 1/2010 | Fitzpatrick | 132/200 |
| 2011/0036370 | A1 * | 2/2011 | Lee | 132/201 |
| 2011/0186073 | A1 * | 8/2011 | Hsu | 132/275 |
| 2012/0174942 | A1 * | 7/2012 | Carey | 132/273 |

* cited by examiner

HAIRSTYLING TOOL

FIELD OF THE INVENTION

This invention relates to a cushioned headpiece worn under a person's hair for creating aesthetic hair styles. More specifically, it relates to a headpiece with a vertical channel through which the person's hair extends upward to cover the headpiece with an elevated hair style.

BACKGROUND OF THE INVENTION

The styling of hair to create aesthetically pleasing personal appearance has been practiced through the ages to the present day. Currently there is great interest in creating elevated hair styles having great fullness and height above the top of the head. An example of such a high-elevation style is the so-called and well-known "beehive" hair style.

Many techniques and devices have been developed to facilitate the creation of elevated hair styles. Typical high hairstyling aids include supplementing natural hair with extra hair attachments such as wigs and "falls" and using special sprays and chemical treatments that cause the hair fibers to stably stiffen and stick together when combed to an elevated style. Other methods utilize mechanical devices worn on the head and in the hair. Some mechanical devices include, for example, clips, combs and bands, and typically involve clamping hair fibers in groups to allow their arrangement in a high-elevation style. Other mechanical devices are bulky objects meant to be worn inside the hair style to provide props for the bulk of the wearer's hair above the device.

Heretofore, there have been a number of patents related to systems for adding height or fullness to hair. The entire disclosure of all U.S. patents and patent applications identified herein are hereby incorporated by reference.

U.S. Pat. No. 6,035,861, for example, discloses a system for adding height to the hair at the crown of the wearer's head. The system comprises two hair inserts which can be identical to each other. Each insert is formed by attaching a natural-looking hairpiece to the main bar of a comb. The system is inserted by the wearer gathering the natural hair at the crown of her head inserting one insert from each side of the gathered hair, such that the teeth of the combs intermesh, frictionally engaging the system in the wearer's hair. Finally, the wearer's natural hair can be arranged over the inserted hairpieces so that the system is completely hidden from view. Moreover, as the system incorporates natural or synthetic hair covering the main bars of the combs, it will not be greatly noticeable or cause embarrassment to the wearer.

U.S. Pat. No. 4,254,783 is directed to a hairpiece having a comb-shaped attaching member designed to provide a natural appearance while securely attaching the hairpiece to the natural hair of the wearer. In a preferred embodiment, artificial hair root is attached to the comb-shaped member at a plurality of dispersed and disconnected hair root attachment sites. These are formed at one side of the comb-shaped member. To provide desired flexibility, the comb-shaped member may be formed with a spring wire core coated with a thermoplastic material which holds the hair roots.

My U.S. Pat. No. 7,484,512 discloses a device for propping up hair comprising a bob member and a comb affixed to the bob member for attaching the device to the user's hair. The bob member is generally brick- or bread loaf-shaped and is covered with fibrous material that can blend with the hair of the wearer to help disguise the presence of the device.

There remains a great need for a hairstyling tool that is able to significantly increase the height of a hair style. There is a need to have a hairstyling tool that can facilitate the creation of a beehive hair style. It is also much desired to have a hair elevating hairstyling tool that is simple, easy and quick to deploy. A tool for creating high hair styles that is comfortable to wear is needed. A self-operating hairstyling tool that can be used to create a highly elevated hairstyle by the wearer alone without assistance by another person is very much wanted.

SUMMARY OF THE INVENTION

A hairstyling tool has a thick, soft cushioned body adapted to be worn on the top of head close to the scalp in cap-like fashion. Optional spring-activated clips affixed to the bottom can be deployed to maintain the tool in position. A substantially vertical channel extending completely through the body allows the wearer to draw sheaves of hair fibers from below the body up, through and above the tool. The upwardly drawn hair fibers can be teased, combed, brushed or otherwise arranged together with other hair of the wearer in a highly elevated style resting on top of the body.

Accordingly, the present invention provides a hairstyling tool comprising (a) a soft, resiliently deformable body having a bottom surface with a concave shape and a top surface, and (b) a channel extending completely through the body from the bottom to the top surface.

The invention also provides a method of styling hair comprising the steps of (I) providing hairstyling tool comprising (a) a soft, resiliently deformable body having a bottom surface with a concave shape and a top surface, and (b) a channel extending completely through the body from the bottom to the top surface, (II) gathering hair fibers on a head of hair being styled to form a sheaf having a base affixed to the head and a free end opposite the base, (III) drawing the free end through the channel such that the bottom surface of the hairstyling tool faces the head and the free end extends beyond the top surface, (IV) moving the body of the hairstyling tool toward the base of the sheaf until the bottom surface contacts the head, and (V) manipulating the hair fibers of the sheaf to form a preselected hair style that rests upon the top surface.

DETAILED DESCRIPTION OF THE INVENTION

Figure 1:
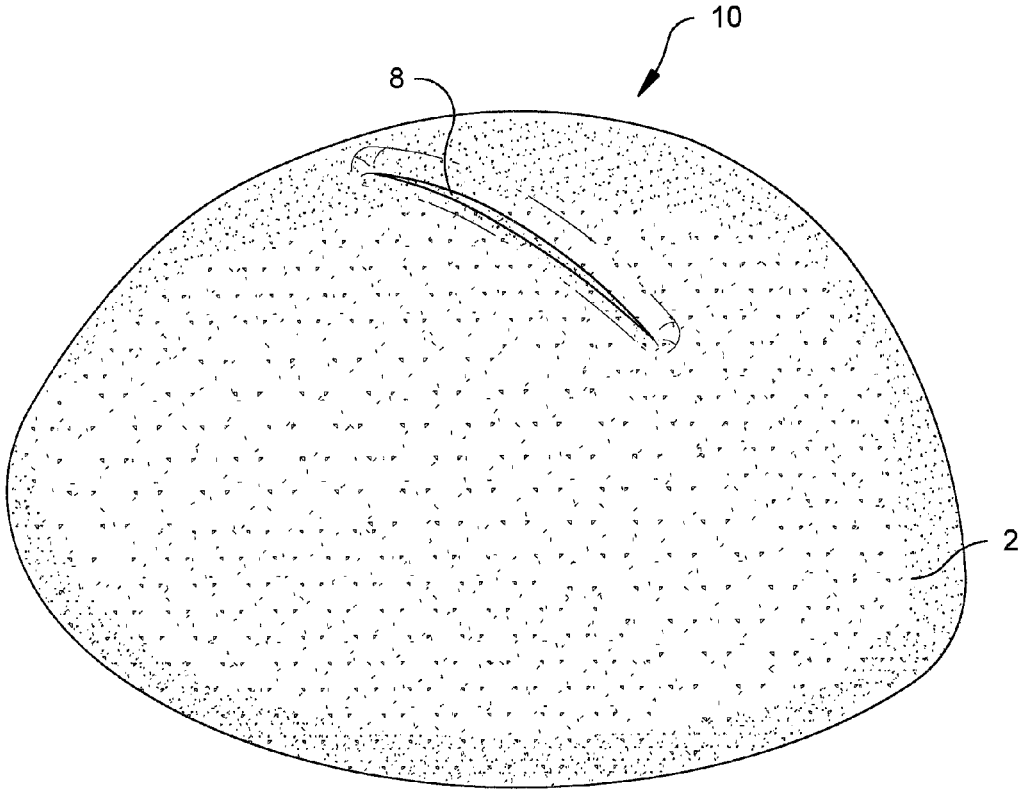
FIG. 1 is a perspective view of a hairstyling tool according to an embodiment of this invention.
Figure 2:
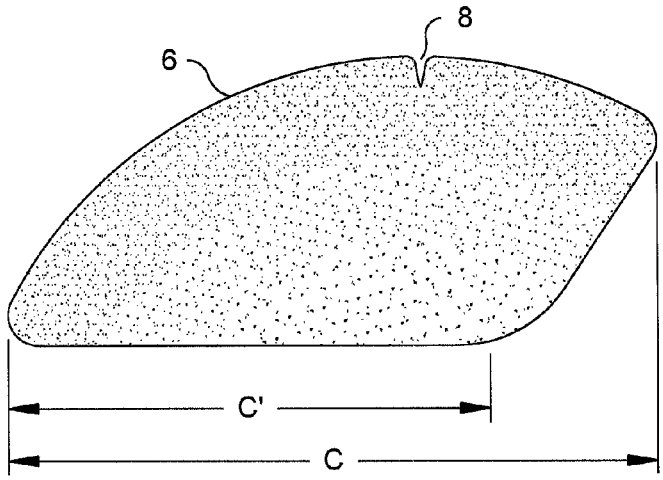
FIG. 2 is a side elevation view of the hairstyling tool of FIG. 1.
Figure 3:
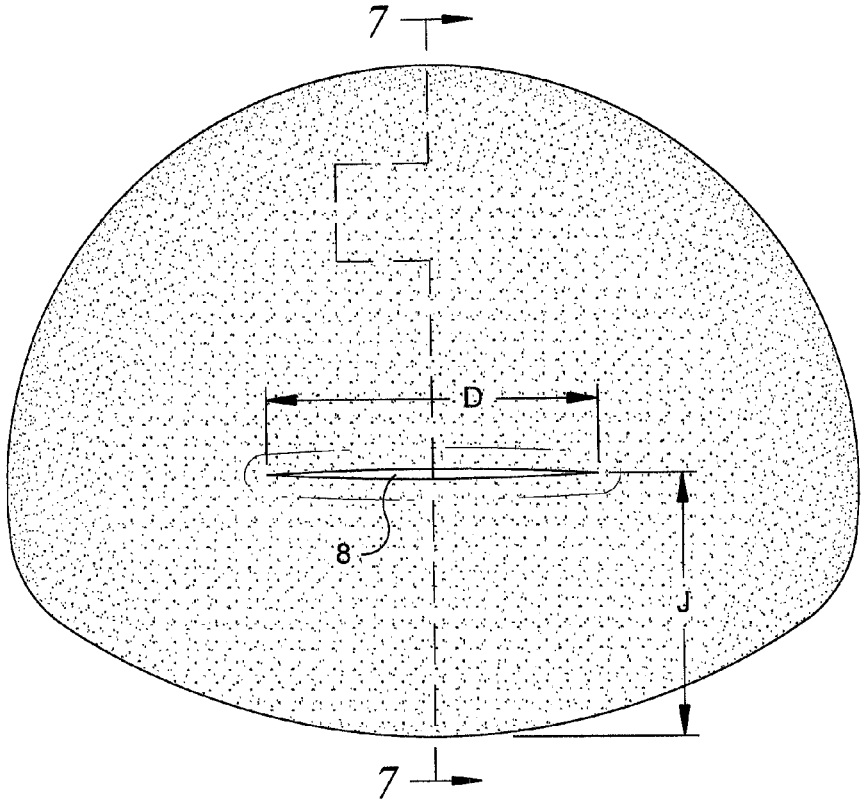
FIG. 3 is a top view of the hairstyling tool of FIG. 1.

With reference to FIGS. 1-7 an embodiment of the novel hairstyling tool 10 is seen to have a smoothly curved, basically helmet-shaped body 2. As will become apparent, the hairstyling tool is worn on the head of the user like a skull cap. The novel hairstyling tool is mainly intended to be worn on the top, central area of the user's head (i.e., the crown of the head) in the region of the parietal bone. This disclosure adopts a convention that refers to the side of the tool that contacts the user's head as the underside or occasionally, the bottom of the tool. The underside defines an underside surface 4 having a concave shape of contour suitable to mate with the convex curvature of a human head. The surface 6 on the top of the body opposite the underside surface is referred to as the outside or top surface of the tool.

The body can be characterized as bulky. A main function of the body is to occupy a volume of space close to the user's head and to support the user's styled hair at a distance above the scalp such that the hair style has an elevated aesthetic appearance. Because the body can cover a relatively large area of the user's head, it is very stable and can support a large amount of hair that is typical of preferred highly piled and broadly based hair styles. Preferably the concave underside surface of the body is contoured to match the convex curvature at the crown of the human head for enhanced stability.

The area of the tool body covers an extensive amount of the user's natural hair. The body also features a channel 8 that extends in a generally vertical orientation between the underside and top. The channel provides a passageway for the user's hairs that emanate from the scalp below the tool to pass through the body and to be joined in the creation of the elevated hair style above and outside the tool.

To maintain the body of the novel hairstyling tool in fixed position laterally and forward-rearwardly on the user's head, one or more fasteners 3 are included. Preferably, the fasteners are affixed to the concave, underside surface of the tool. These fasteners are intended to grip the user's hair near the scalp and thereby prevent lateral movement of the tool body relative to the user's head. The fasteners also serve to clamp the tool close to the user's head. Thus they provide resistance to vertical separation from the head, for example, as might otherwise tend to occur when worn in windy conditions or when the user makes sudden abrupt movements. An advantageous feature of the novel hairstyling tool is that the sheaf of the user's hair extending through the channel further helps to anchor the tool to the user's head adding stability to the hair style.

Figure 4:
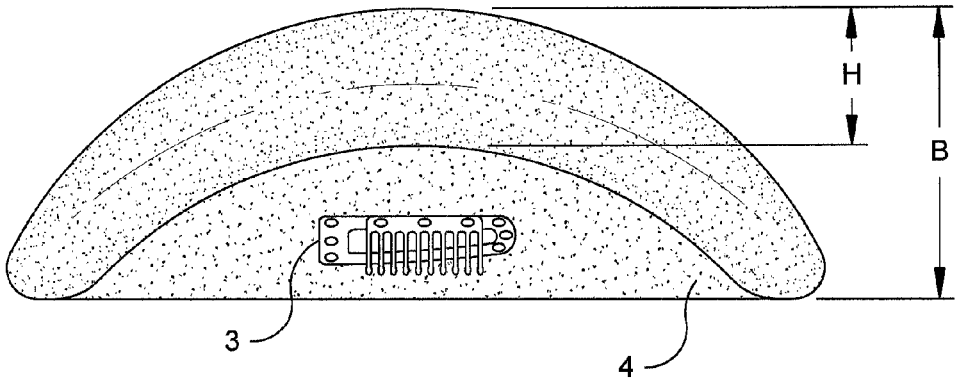
FIG. 4 is a front elevation view of the hairstyling tool of FIG. 1.
Figure 5:
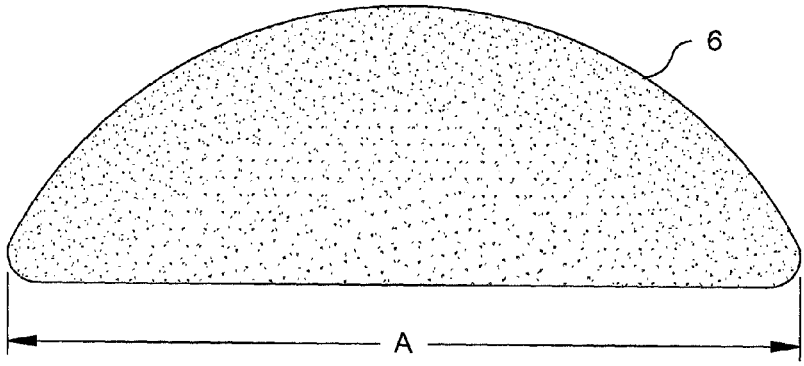
FIG. 5 is a rear elevation view of the hairstyling tool of FIG. 1
Figure 6:
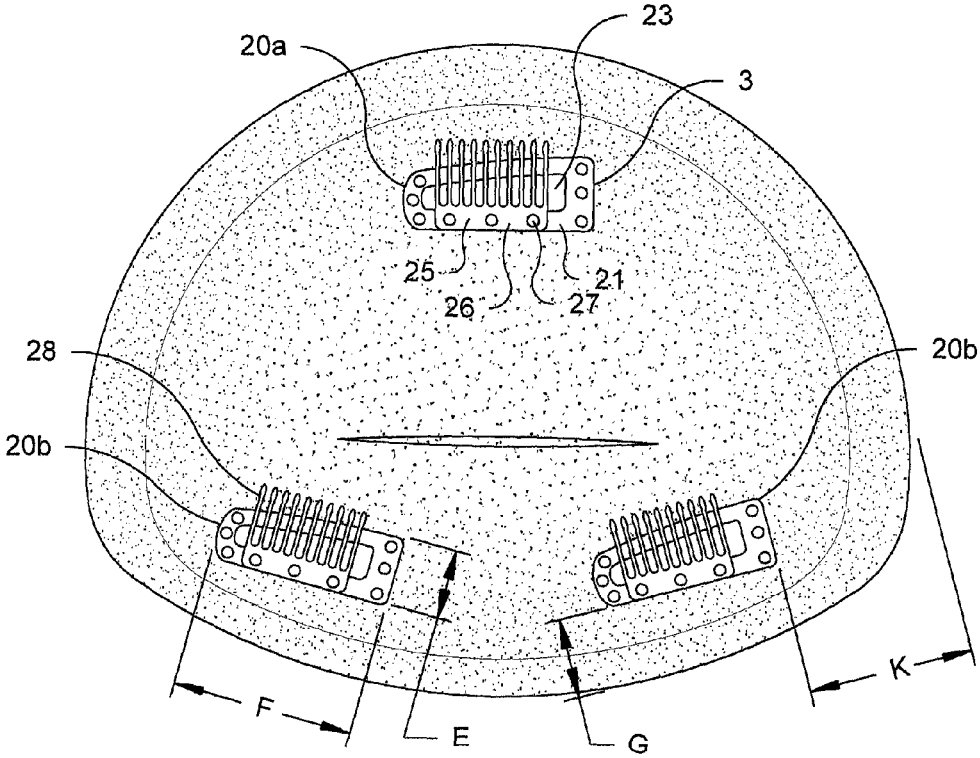
FIG. 6 is a bottom view of the underside of the hairstyling tool of FIG. 1.

The fasteners can be conventional hair-fastening devices. Representative examples include a comb, a snap clip, a barrette, a hairpin, a bobby pin and a combination thereof. A preferred fastener is the snap comb clip that combines the functions of a a snap clip and a comb. Such representation of such a device is illustrated in FIGS. 4 and 6. The snap comb may be plastic or metal composition. It typically has a two piece construction. A frame 21 is a generally elongated frame configured to surround a central, hollow area 23 defined by the frame. Optionally, the first piece can be a solid sheet without a hollow central area. The second piece is a comb 25. The handle 26 of the comb is affixed to one edge of the frame such that the teeth of the comb lie across and adjacent to the frame. The comb handle is affixed to the edge of the frame 21, typically with rivets or welds 27. The pieces are thus affixed while both comb and frame are bent in a slight curve defining a closed conformation with the comb teeth contacting a side of the frame. When pressure is applied against the convex side of the curve, the frame flexes, and the comb teeth 28 separate from the frame in an abrupt, snapping motion that may be accompanied by a clicking sound. The snap comb then defines an open confirmation providing a gap between the teeth and frame. When pressure in the opposite direction is applied, the snap comb instantly returns to its closed conformation with the comb teeth contacting the frame.

In a preferred embodiment seen in FIG. 6, three snap comb fasteners 3 are utilized on the underside surface of the tool body. One fastener 20*a* is centrally disposed in a rearward position. The two other fasteners 20*b* are positioned forward on the body and laterally apart from each other. As shown, the comb teeth point rearward. In another embodiment, the comb teeth point forward. Preferably, all the comb fasteners are oriented in the same general direction. Such orientation facilitates deployment of the hairstyling tool by allowing the tool to slide into position on the head in a single direction and thereby cause all the fasteners to engage the user's hair near the scalp.

In another preferred embodiment the snap comb fasteners all are oriented such that the comb teeth point inwardly, i.e., toward the center of the bottom surface. This arrangement can provide a firm grip to maintain the tool in position.

The body 2 of the hair styling tool should be of a soft, resilient, lightweight material. Preferably the body material is a foam form. The foam preferably has a moderately, sponge-like, elastic, compressibility. Thus the body can deform under manual pressure but will return to its undeformed shape substantially completely when the pressure is removed.

The body material should be structurally strong enough to support hair of the user that will be formed to an elevated hair style. Preferably the edges defining the body shape are rounded for comfort of the user.

Preferably the foam of the body material is a synthetic polymeric composition. Various conventional foam compositions and methods for making them can be used to make the foam body. For example, the body can be molded with the foam expanding to the shape of the body within a mold, or the body can be sculpted from a large, crudely shaped block of foam.

Figure 7:
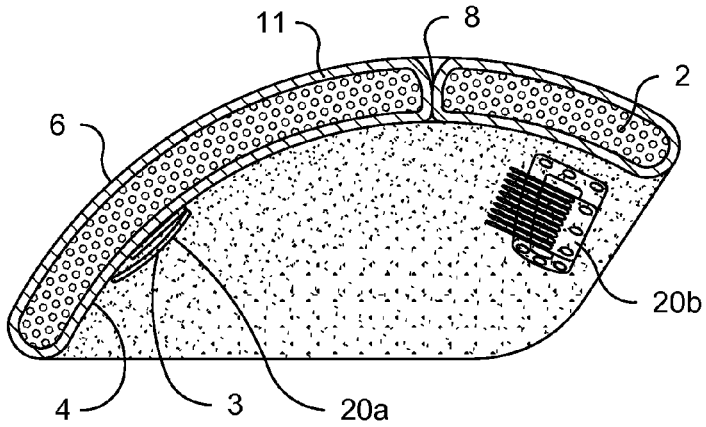
FIG. 7 is a section view of the hairstyling tool taken along line 7-7 in FIG. 3.

Synthetic foam material employed in the body of the tool can have various degrees of abrasion resistance. Primarily to improve abrasion resistance and structural integrity of the body, it is preferable to envelope the foam of the body in an outer layer of a close-fitting, stretchable, elastic fabric 11 (FIG. 7). The elastic fabric should be a sheer knit or woven fabric comprising elastic fibers having a textile decitex. The term "textile decitex" means fibers in the range of about 1 to about 22 dtex. The fabric should have a stitch count of at least about 10 stitches per inch and preferably about 10-50 stitches per inch. An exemplary composition for the elastic fibers is Lycra® spandex fabric. Preferably all the fibers of the enveloping fabric will be elastic. The elastic fabric can have the appearance and stretch characteristics of a fine mesh leg stocking, for example.

The surface area of the body is slightly larger than the elastic fabric of the outer layer. Thus the elastic fabric enveloping the body is in a stretched state. The outer layer of elastic fabric is held close to the surface of the body by elastic force. It is optional to mechanically attach the outer layer elastic fabric directly to the body, for example as by stitching or adhesive. The elastic fabric may be tacked at preselected anchor positions on the surface of the body to prevent gathering. Preferably the elastic fabric is not mechanically attached to the body.

The shape of the novel hairstyling tool is not limited to the generally low profile (i.e., slightly convexly curved), outside surface 6 of the illustrated embodiment. The outer surface can optionally include steeply graded mountainous peaks, for example with peak heights protruding from about 1.5 to about 4 inches above the convex curvature shown. These peaks enable the user's hair to be built up to greater extreme elevations above the head.

The channel passing substantially vertically through the body is a defining prominent characteristic of the novel hairstyling tool. The channel is typically formed as a narrow slit in the body material. It should be understood that when the hairstyling tool is enveloped by an outer layer of elastic fabric, this outer layer follows the contours of the body surface through the channel. That is, the elastic fabric 11 lines the inner opposing faces of the slit that forms the channel 8 as seen in FIG. 7.

Characteristic dimensions of the novel hairstyling tool are identified by alphabetical labels in FIGS. 2-6. In a preferred embodiment for a medium-sized user's head, these characteristic dimensions have the following numerical values. The overall width A is about 3-7 inches, preferably about 5.5 inches, height B is about 1-3 inches preferably about 1.75 inches and length C from front to rear is about 2-5 inches, preferably about 4.5 inches. Length C' of the side is about 2-5 inches, preferably about 4 inches. The width D of channel 8 is about 1-4 inches, preferably about 2.5 inches. Each of the combination snap comb fasteners 3 has a width E of about ½-1½ inch, preferably about 9/16 inch and a length F of about 1-2 inches, preferably about 1.5 inch. The distance G between snap comb fasteners and the inside edge of the hairstyling tool is about 0.25 to about 0.40 inch. The two laterally aligned fasteners 20*b* are about 1-3 inches, preferably about 1.5 inches apart and are a distance K of about 0.5-1.5 inches preferably about 0.75 inches from the side of the body. Thickness H of the body is about 0.25-2.5 inches, preferably about 0.5 inch. Distance J from the forward edge of the body to the center line of the channel is about 1-3 inches, preferably about 1.6 inches.

The dimensional values can be varied from those recited above to accommodate heads and hair styles of different sizes. That is, larger tool bodies would fit larger heads than smaller tool bodies. Moreover, the contour and radius of curvature of the concave underside surface 6 can be selected to conform to the particular shapes of individual users' heads.

Figure 9:
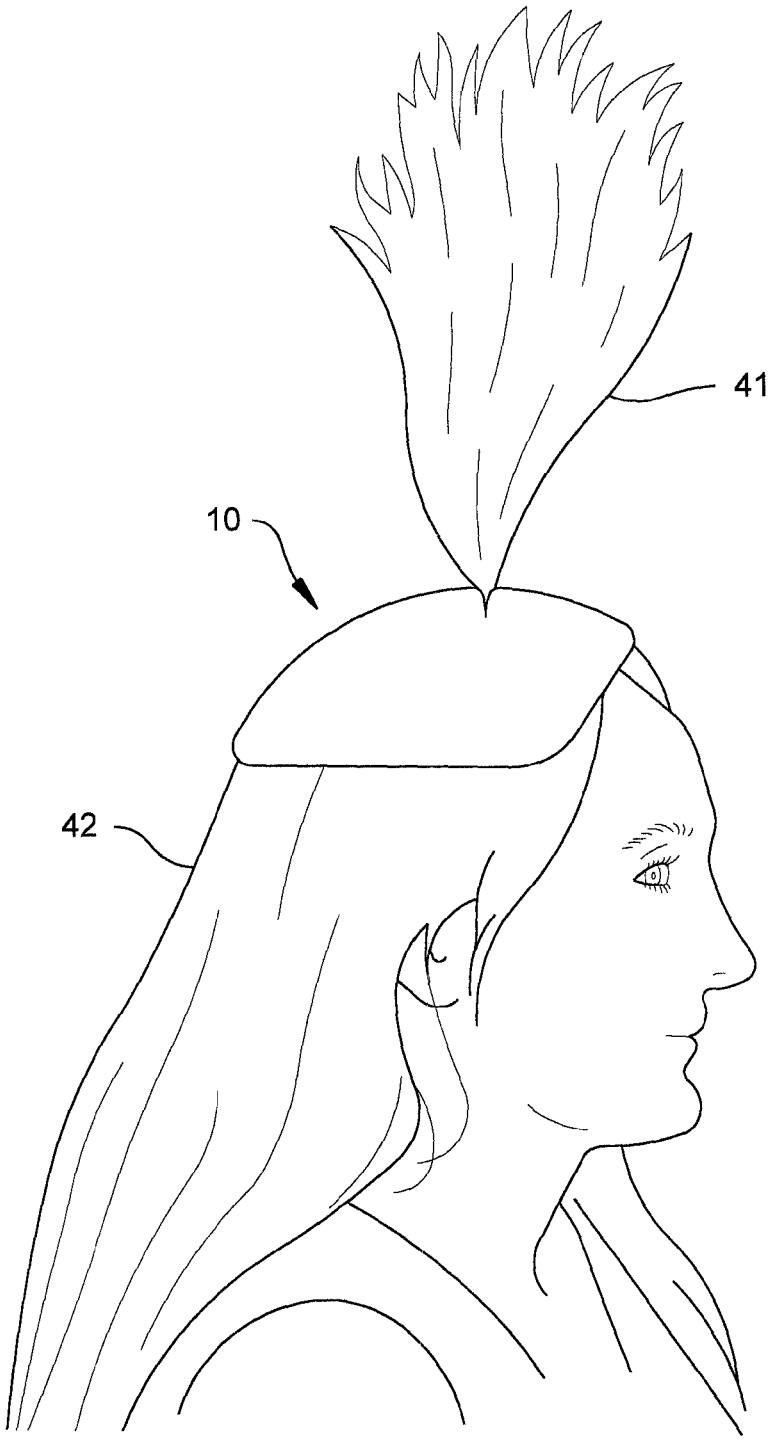
FIG. 9 is a perspective view of a hairstyling tool according to this invention being worn by a person in an intermediate stage of creating an elevated hair style.
Figure 10:
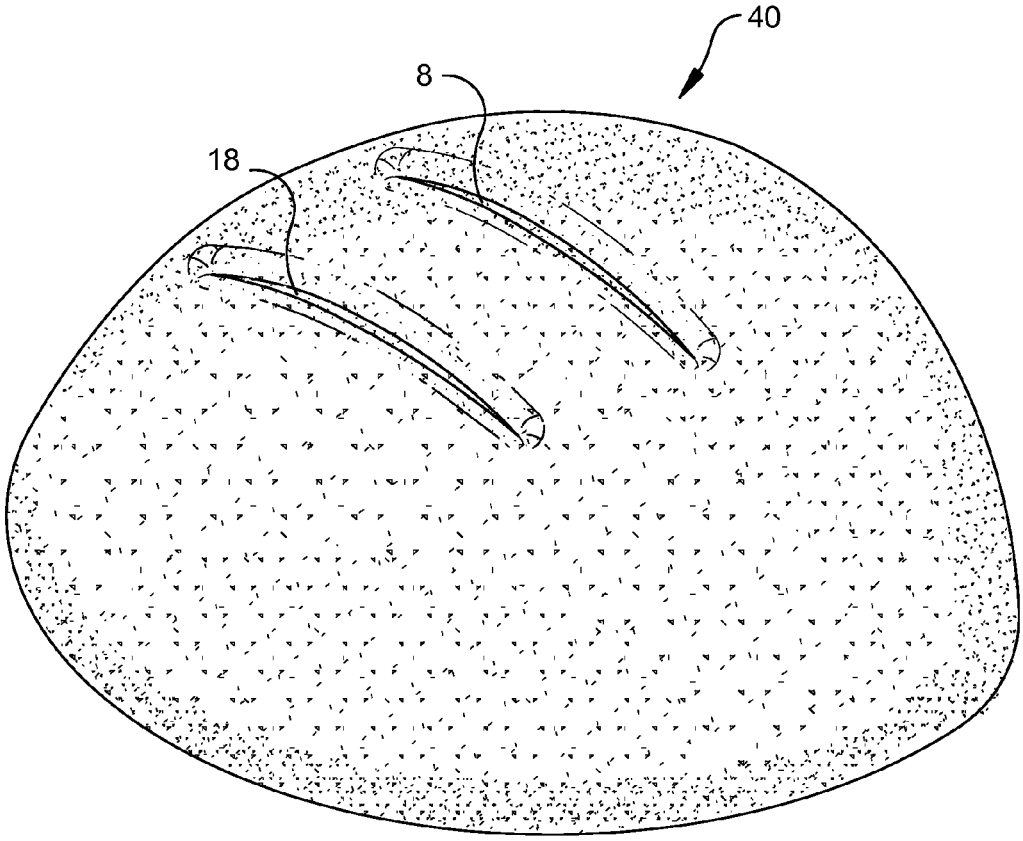
FIG. 10 is a perspective view of a hairstyling tool 40 according to an embodiment of this invention that has a plurality of channels (8 and 18) extending completely through the body from the underside to the top surface of the hairstyling tool.
Figure 11:
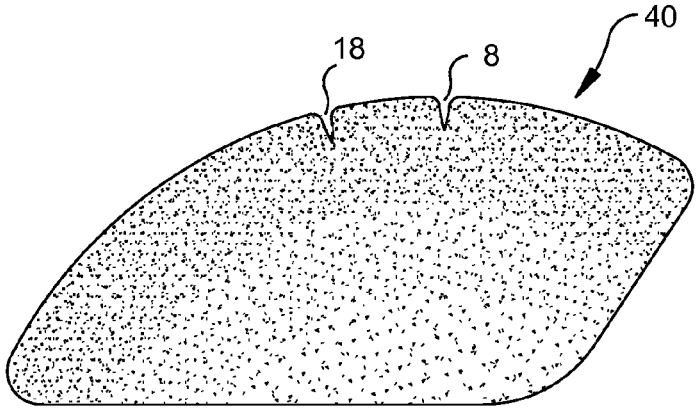
FIG. 11 is a side elevation view of the hairstyling tool 40 of FIG. 10.

A user desiring to implement an elevated hair style can deploy the novel hairstyling tool generally as follows. The user locates an area on top of the head. The user gathers the hair of this area in one or more sheaves 41. Preferably the hair is gathered in sheaves positioned in a central region of the area. The hair strands within these sheaves can optionally be combed or brushed at this point. Mainly it is desirable to align the hair strands so that all the hair of the sheaves can be manipulated as a very small number of sheaf units, and preferaby in a single sheaf of the gathered hair as seen in FIG. 9. The user can optionally apply one or more elastic hair bands around the sheaf to maintain the hairs in the sheaf conformation.

Next the user opens the fasteners of the underside surface of the tool so that they are ready to engage the base of hair strands, i.e., hair close to the scalp. Holding the body of the tool about and inch above the head and over the area from which the sheaves are based, the user pulls the free end of the sheaves upward through the channel of the tool body. When the full extent of the sheaves of hair are extending above the tool, the users pushes the tool body downward into contact with the head in the position illustrated in FIG. 9. Moving the tool horizontally in the direction of the fastener comb teeth, the fasteners will engage the bases of hair fibers. At this point the fasteners can be closed to firmly grasp the hair fibers and thereby prevent the now deployed hairstyling tool from moving laterally on the user's head. Because the body of the hairstyling tool is soft and pliant, the circumferential edges can be lifted easily give the user's fingertips access to the fasteners on the underside. Thus the user can activate and deactivate the fasteners to secure and release the tool while the body is in close proximity to the head. The user can then comb and/or brush out the hair from the sheaves to form a hair style. Other parts 42 of the user's hair that does not pass through the channel can be blended with the hair extending from the channel to cover and conceal the tool beneath an aesthetically appealing hair style. The hair style will be supported by the upper surface of the hairstyling tool and thus have an enhanced elevation. The final hair style can be sprayed, pinned or otherwise affixed in a conventional manner by traditional means to maintain the elevated hair style.

To remove the hair style and the tool, the user combs out the hair style, loosens the fasteners that hold the tool body close to the head thereby disengaging the fasteners from the hair. The tool body is then pulled upward. The formerly sheafed hair can be easily pulled downward back through the channel and the tool can be withdrawn.

Figure 8:
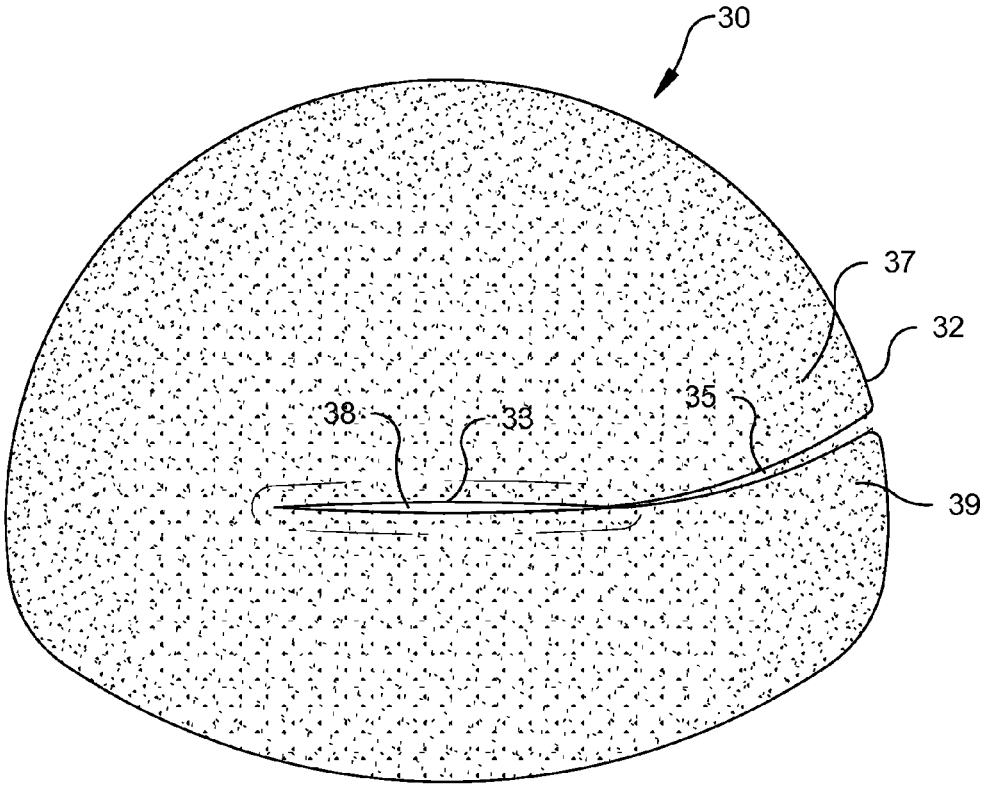
FIG. 8 is a top view of a hairstyling tool according to another embodiment of this invention.

A user might find pulling the sheaf or sheaves of hair through the narrow aperture of the channel to be inconvenient or awkward. Another preferred embodiment of the novel hairstyling tool 30 as shown in plan view in FIG. 8 can be utilized for easier deployment of the hairstyling tool. This tool body also has a channel 38 through which the sheaves of hair are to be passed. It is also shaped substantially similarly to the shape of the novel tool shown in FIGS. 1-6. However, channel 38 extends from a channel location 33 centrally disposed on the body, laterally to the perimeter 32 of the tool body. The extended segment 35 of the channel might simply align directly with the centrally disposed channel section 33. It is contemplated that the extended segment 35 preferably sweeps rearward in a curve dividing the body into two regions 37 and 39. One advantage of causing the extended channel segment to curve rearward is that such curvature does not interfere with placement of the forward fastener on the underside of the body region 39.

Use of this embodiment of the hairstyling tool is similar to the method for the embodiment of FIGS. 1-6. However, advantageously, the sheaves of hair need not be threaded through the eye of the channel as before. Instead, the sheaves of hair can be held in substantially vertical orientation with one hand high on the sheaves while the extended channel segments 37 and 39 are moved slightly apart from each other. The body of the tool should be flexible enough to allow segments 37 and 39 to spread while the sheaves are passed laterally into the extended channel from the side of the tool body. With the segments spread slightly, the hair can be moved toward the central channel segment 33 near the middle of the hair style area. Due to its elastic nature, the body should then return to nearly its original conformation closing the narrow gap at the extended segment 35.

Although specific forms of the invention have been selected in the preceding disclosure for illustration in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims. The entire disclosures of U.S. Patents and applications named in this application are hereby incorporated by reference herein.

What is claimed is:

1. A hairstyling tool comprising (a) a soft, resiliently deformable body comprising a sponge-like, elastically compressible, polymeric foam and the body having an underside defining an underside surface with a concave shape and a top surface and, (b) a slit extending completely through the body from the underside to the top surface.

2. The hairstyling tool of claim 1 which further comprises a fastener affixed to the underside surface of the body, the fastener being operative to removably attach the hairstyling tool to hair of a wearer.

3. The hairstyling tool of claim 2 in which the fastener is adapted to engage the hair of the wearer and is selected from the group consisting of a comb, a snap clip, snap comb clip, a barrette, a hairpin, a bobby pin and a combination thereof.

4. The hairstyling tool of claim 3 in which the fastener is a snap comb clip.

5. The hairstyling tool of claim 2 in which the tool comprises a plurality of fasteners affixed to the underside surface of the body.

6. The hairstyling tool of claim 1 in which the concave shape of the underside surface has a smooth contour suitable to conform to the convex curvature of a human head.

7. The hairstyling tool of claim 6 in which the body has a thickness between the top surface and the underside surface in the range of about 0.25-2.5 inches.

8. The hairstyling tool of claim 7 in which the thickness is substantially uniform.

9. A method of styling hair comprising the steps of (I) providing a hairstyling tool comprising (a) a soft, resiliently deformable body comprising a sponge-like, elastically compressible, polymeric foam and the body having an underside defining an underside surface with a concave shape of contour adapted to mate with a convexly curved area of a human head, and a top surface, and (b) a slit extending completely through the body from the underside surface to the top surface, (II) gathering hair fibers on a head of hair being styled to form a sheaf having a base affixed to the head and a free end opposite the base, (III) with the hairstyling tool oriented such that the underside surface of the hairstyling tool faces toward the head, drawing the free end of the sheaf of hair fibers through the slit and extending the free end beyond the top surface, (IV) moving the body of the hairstyling tool toward the base of the sheaf until the underside surface contacts the head, and (V) manipulating the hair fibers of the sheaf to form a preselected hair style that rests upon the top surface.

10. The method of claim 9 in which the hairstyling tool further comprises a fastener affixed to the underside surface of the body, and in which the method further comprises clamping the fastener to the hair of the head thereby removably attaching the hairstyling tool to the head.

11. The hairstyling tool of claim 5 in which the tool comprises three snap comb clips affixed in a triangular arrangement to the underside surface of the body.

12. A hairstyling tool comprising (a) a soft, resiliently deformable body comprising a sponge-like, elastically compressible, polymeric foam and having an underside defining an underside surface with a concave shape and a top surface, (b) at most one narrow, elongated slit, extending completely through the body from the underside to the top surface, in which the body continuously surrounds the slit, and (c) an outer layer of close-fitting elastic fabric enveloping the body.

* * * * *